US005534282A

United States Patent [19]

Garwood

[11] Patent Number: 5,534,282

[45] Date of Patent: Jul. 9, 1996

[54] PACKING PERISHABLE GOODS

[75] Inventor: Anthony J. M. Garwood, Hawthorn, Australia

[73] Assignee: Seawell North America Inc., Wilmington, Del.

[21] Appl. No.: 265,932

[22] Filed: Jun. 27, 1994

Related U.S. Application Data

[63] Continuation of Ser. No. 137,261, Oct. 18, 1993, abandoned, which is a continuation of Ser. No. 835,976, filed as PCT/AU90/00385, Aug. 30, 1990, abandoned.

[30] Foreign Application Priority Data

Aug. 30, 1989 [AU] Australia ..... PJ6039

[51] Int. Cl.[6] ..... B65B 7/16; B65B 31/02

[52] U.S. Cl. ..... 426/396.000; 53/284.5; 53/329.4; 53/329.5; 53/432; 53/467; 53/473; 53/477; 53/488; 53/510; 426/411; 426/413

[58] Field of Search ..... 426/106, 129, 426/263, 392, 396, 411, 413; 53/284.5, 329.4, 329.5, 432, 433, 467, 473, 477, 485, 488, 510, 511; 206/213.1

[56] References Cited

U.S. PATENT DOCUMENTS 4,840,271 6/1989 Garwood ..... 206/213.1

5,155,974 10/1992 Garwood ..... 53/510

FOREIGN PATENT DOCUMENTS

| | | |
|---|---|---|
| 461520 | 9/1971 | Australia . |
| 2041318 | 2/1979 | United Kingdom . |
| WO87/02965 | 5/1987 | WIPO . |
| WO88/00907 | 2/1988 | WIPO . |
| WO89/03789 | 5/1989 | WIPO . |

*Primary Examiner*—Leo B. Tentoni
*Attorney, Agent, or Firm*—Foley & Lardner

[57] ABSTRACT

A method and apparatus for packaging perishable goods such as red meat. The packaging contains a base (1), a lid (3), and a flexible web (5) of gas permeable material held over the goods (7) so the goods are held to the base (1). A suitable gas is retained within the packaging which can permeate the flexible web (5) to enhance the keeping properties of the goods (7). The method and apparatus provide that the flexible web (5) is held between a pair of web holding means (65) and stretched towards the goods (7) as the lid (3) is moved to close the package, all within a gas flushing chamber. Such stretching holds the goods (7) firmly to the base (1).

23 Claims, 10 Drawing Sheets

85
65
75
131
97
87
69
19
25
21
31
29
33
79
103
87
95
93
127
129
61
91
3
113
109
105
111
1
101
7
117
123
115
119
121
5
133
107
125
89
67
83
81

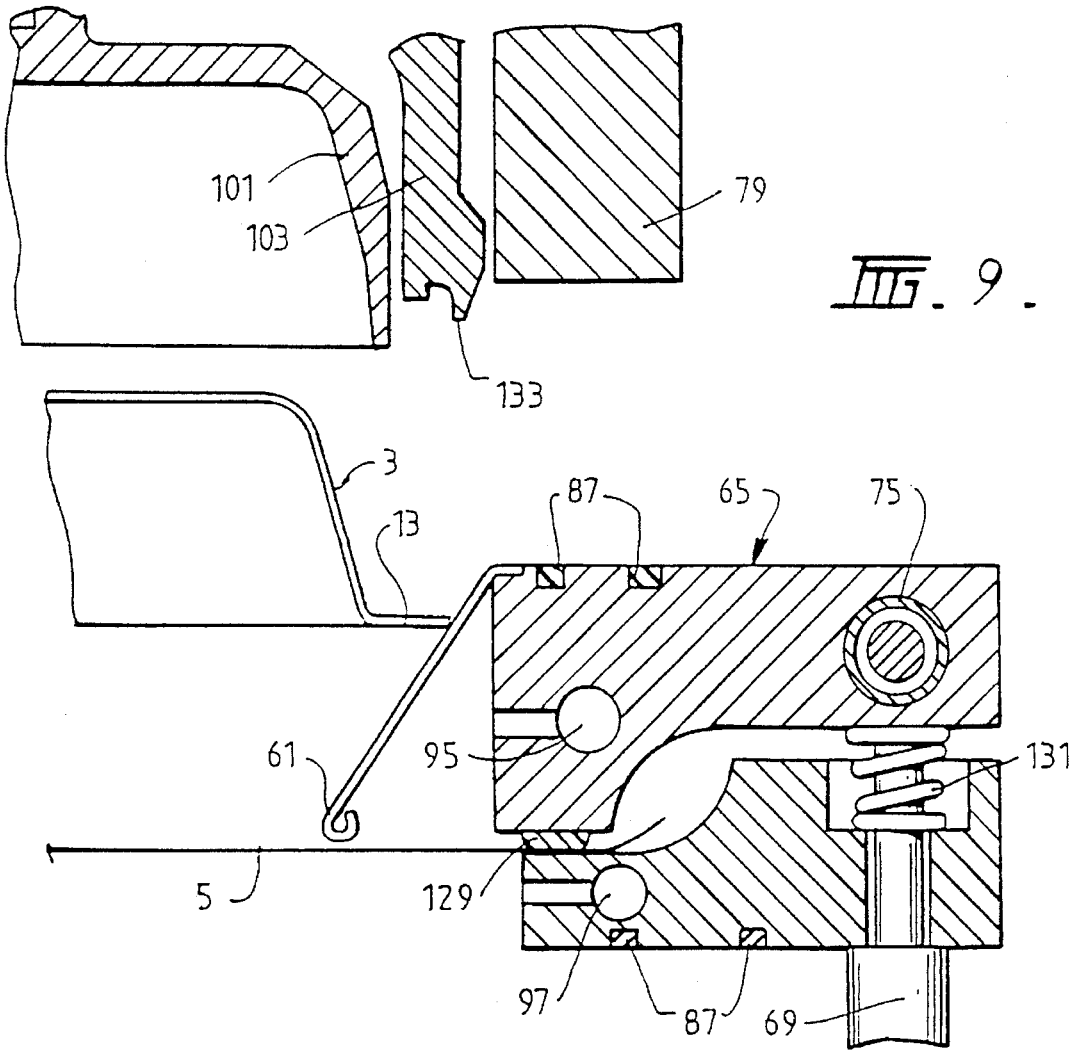
FIG. 9.
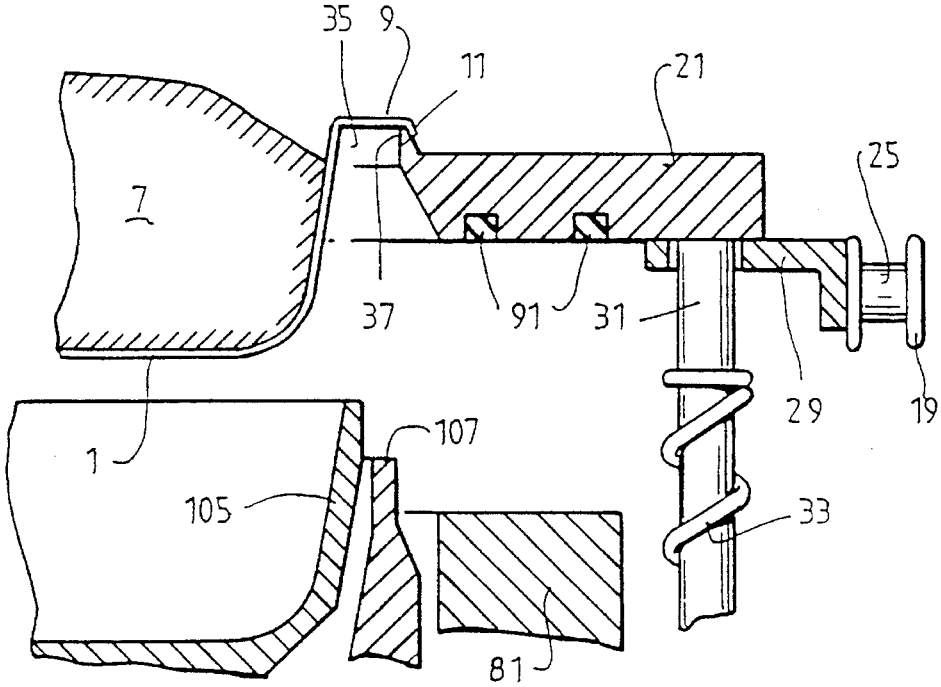

PACKING PERISHABLE GOODS

This application is a continuation, of application Ser. No. 08/137;261, filed Oct. 18, 1993, now abandoned, which is in turn a continuation of Ser. No. 07/835,976, filed Feb. 27, 1992, now abandoned, which is a National Stage of PCT/AU90/00385.

FIELD OF THE INVENTION

This invention-relates to improved packaging and relates particularly, but not exclusively, to improved packaging for perishable goods such as food stuffs and relates particularly, but not exclusively, to the packaging of meats such as red meats.

DESCRIPTION OF PRIOR ART

Hitherto, in the art of packaging these goods there have been several proposals. Typical examples of prior art packaging of this type are disclosed in PCT patent applications Ser. Nos. PCT/AU86/00339, PCT/AU87/00243, PCT/AU87/00297, PCT/AU88/00424 and PCT/AU89/00308.

OBJECTS AND STATEMENT OF INVENTION

The present invention relates to an improvement in the method of assembly of packaging of the above general type and apparatus suitable for performing such method.

In apparatus and methods disclosed in the aforementioned patent specifications it has been necessary to effect skin wrapping or partial skin wrapping of the goods at one station and then move the part assembled package to a second station where a lid is applied thereto and a suitable gas provided under the lid. The gas can permeate through the flexible web to enhance the keeping qualities of the packaged goods such as red meats. For red meats the gas, which is provided between the lid and the flexible web, comprises 80% $O_2$ and 20% $CO_2$. Other gases and combinations of gases may be used. Typically, the base and the lid present gas barriers so that the perishable goods are not contacted by the atmosphere.

According to a first broad aspect of the present invention there may be provided an improved method for packaging perishable goods comprising the following steps:

(a) providing a base with perishable goods over said base;
(b) aligning a flexible web of material over said base and said perishable goods;
(c) aligning a lid over said flexible web, and in alignment with said base and said perishable goods;
(d) applying a member to said flexible web to stretchingly deform said flexible web towards said perishable goods over said base;
(e) closing a gas flushing chamber means over said base and said lid;
(f) gas flushing said gas flushing chamber with a suitable gas for enhancing the keeping properties of the perishable goods;
(g) relatively moving said lid, the stretchingly deformed flexible web, and the base together within said gas flushing chamber;
(h) causing the stretchingly deformed flexible web to engage with said perishable goods and said base; and
(i) sealing said lid, said flexible web and said base together whereby said perishable goods will be held to said base and there will be said suitable gas within said packaging.

According to a further broad aspect of the present invention there may be provided apparatus for providing packaging comprising:

a gas flushing chamber means of sufficient volume to accommodate:

(i) a base with perishable goods over said base;

(ii) a flexible web of material over said base and said perishable goods;

(iii) a lid over said flexible web of material and in alignment with said base and said perishable goods;

said base being supportable on a base support means, said flexible web being, in use, between a pair of web holding means;

there being stretching means between said lid and said flexible web; and sealing means for effecting sealing of said lid, said flexible web and said base together, all within said gas flushing chamber means, the arrangement being such that said stretching means can be moved to stretchingly deform said flexible web towards said perishable goods following holding of said flexible web by said web holding means and there can be relative movement of said base support means, said web holding means, said lid and said member towards each other, whereby said base, said stretchingly deformed flexible web and said lid can be brought together and sealed together with a desired gas between at least said flexible web and said lid within said gas flushing chamber, and so said perishable goods will be held to said base by said flexible web being stretched and engaged with said goods to hold said goods to said base.

The successive order of stretching the flexible web and the moving together of the stretched flexible web and the base, and the subsequent gas flushing can be changed without departing from the inventive concept. Thus, for example, the method steps recited need not be followed successively.

BRIEF DESCRIPTION OF THE DRAWINGS

In order that the present invention can be more clearly ascertained an example of a preferred embodiment for packaging red meats will now be described with reference to the accompanying drawings, wherein:

FIGS. 9 through 13 are detailed close-up cross sectional views showing part of the view shown in FIG. 8 at various process steps in the bringing together of the packaging components and the subsequent sealing together of the package.

DETAILED DESCRIPTION OF PREFERRED EMBODIMENTS

Figure 1:
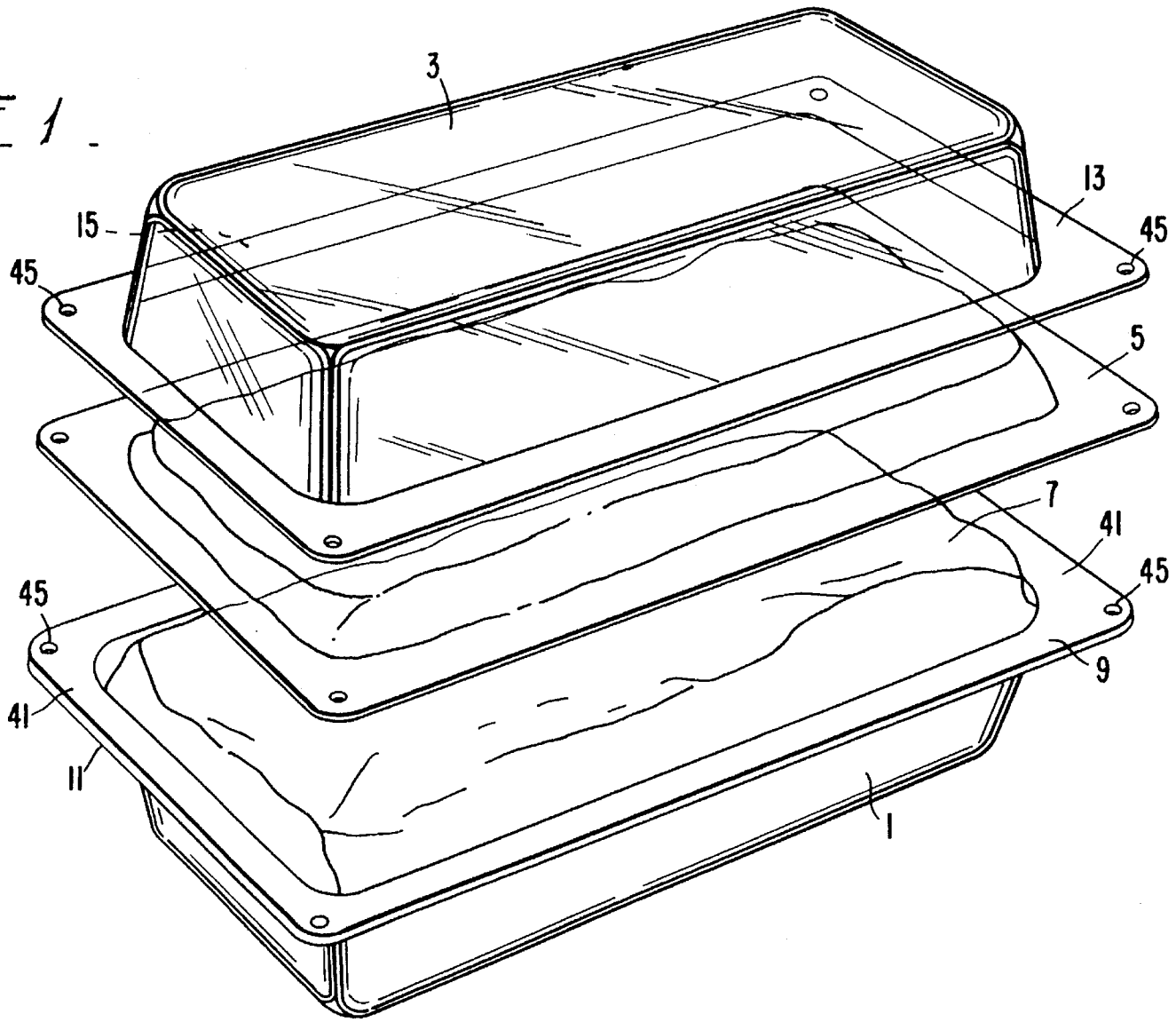
FIG. 1 is an exploded perspective view of a typical preferred packaging.

Referring now to FIG. 1 there is shown a plastics material packaging in exploded form, containing red meats. The packaging comprises a base 1, a lid 3, and a flexible web 5 between the lid 3 and the base 1. Perishable goods such as red meat 7 are provided over the base 1. It is noted the base 1 is generally of a shallow, rectangular, cup-shape depression and the lid 3 is of a corresponding rectangular, cup-shape upstanding depression. The base 1 has a peripheral lip 9 with a down turned outer edge 11. The lid 3 has a lip 13 similar to lip 9 of the base 1 but the lid 3 does not have any down turned outer edge. The height of the goods 7 is above the lip 9 on the base 1. The height of the rectangular, cup-shaped depression in the lid 3 is such that there will be a space 15 between the lid 3 and the flexible web 5. A suitable gas for enhancing the keeping properties of the goods 7 is provided in at least that space 15. Typically, the suitable gas can also be provided under the flexible web 5 in the remaining portion of the depression in the base 1 not filled by the goods 7. The flexible web 5 may be a continuous web of a suitable plastics material which will exhibit gas permeability qualities so that the suitable gas within the space 15 can permeate the flexible web 5 and contact the surface of the goods 7. Similarly, any gases which may generate within the package between the base 1 and the flexible web 5 may permeate through the flexible web 5 and into the space between the flexible web 5 and the lid 3.

The flexible web 5 may comprise a sheet of plastics material with perforations or openings therein and/or it may comprise a mesh web of material or mere strands of material. In this instance, the gas which is within the package can freely circulate through the flexible web 5 and contact the goods 7.

Typically, the volume of gas within the package is provided to equal approximately the volume of the goods 7. In the case of the goods 7 being red meats the gas can be 80% $O_2$ or 20% $CO_2$, or any other gas or combination of gas which is known for enhancing the keeping qualities of the perishable goods 7.

Typically, the base 1, the flexible web 5 and the lid 3 are transparent although it is possible to have the base of a non-transparent material. This may be required in some instances of packaging red meat where fluids exude from the meat and these need to be absorbed in a wad of material under the meat. In this way the fluids will not appear readily to an intending purchaser and will not detract from the overall impression created by the packaging.

Typically, the plastic material in the base 1 is 300 micron thick, the flexible web 5 16–50 micron thick, and the lid 3 300 micron thick. Thus, the base and the lid will be substantially rigid and the flexible web 5 will be relatively flexible. A particularly preferred plastics material for the base 1 comprises a multilayer web having an upper layer of polyester and a lower layer of low density polyethylene. An adhesive material which is heat activatable is provided between the two layers. A typical material for the flexible web 5 comprises a multiweb having upper and lower webs of linear low-density polyethylene which are held together with a heat activated adhesive of the EVA type. A typical material for the lid 3 comprises a multilayer web having an outer layer of polyester and a lower layer of low density polyethylene with anti-fog held together with a suitable adhesive which can be heat activated. The base web, skin web, and lid web materials are each formed by co-extruding the required plastics materials and bringing them together to form the required web with an adhesive layer therebetween. Thus, each of the webs of material for the base 1 the flexible web 5 and the lid 3 can comprise a plurality of individual webs suitably bonded together. The plastics material are such that the base 1 can be sealed to the flexible web 5 and the lid 3 can be sealed to the flexible web 5 by suitable sealing means such as a heat sealing means thereby to provide a totally hermetically sealed package. The flexible web 5 is stretchingly engaged over the goods 7 and sealed to the base 1 so that the goods 7 are held relative to the base 1 by the flexible web 5 being stretched and sealed to the base 1 so the goods 7 cannot flop around within the packaging.

In another preferred embodiment of packaging the base 1 can be a five layer co-extruded web having an upper or inner layer of low density polyethylene of about 0.0015 inches thickness which may be white or clear and which contains anti-fogging agent. The next layer may comprise an adhesive which is heat activatable of a thickness of 0.0005 inches thick which may be white or clear and which may contain an anti-fogging agent. This layer may be solid sheer white pigment plastics. The next layer may comprise an amorphous polyester re-grind containing an adhesive, an LPDE and white pigment which are collectively a re-grind material having a thickness of about 0.008 inches thick. The lowermost layer may comprise an amorphous polyester of approximately 0.005 thickness which may be a solid sheer white pigment. In this case the base 1 will be non-transparent. The total thickness of the material in the base 1 will be in the order of 0.015 inches thick and therefore will be relatively rigid compared to the flexible web 5. The flexible web 5 may comprise a three layer co-extruded structure having an upper layer of low density polyethylene of about 0.0005 inches thick which is water clear and contains an anti-fogging agent. The middle layer may comprise an adhesive of approximately 0.0005 inches thick which is water clear. The lower layer may comprise a surlyn or equivalent plastics material of 0.005 inches thick which is water clear and contains an anti-fogging agent. The flexible web 5 will have a total thickness of about 0.002 inches thickness and will be quite flexible. The lid 3 may comprise a three layer co-extruded structure having an upper or outer layer of an amorphous polyester of about 0.013 inches thickness which is water clear. The middle layer may comprise an adhesive of approximately 0.0005 inches thickness which is water clear. The lower or inner layer may comprise a low density polyethylene of about 0.0015 inches thickness which is water clear and contains an anti-fogging agent. The total thickness of the lid 3 may be in the order of 0.15 inches thickness and therefore be relatively rigid compared to that of the flexible web 5.

If the flexible web 5 is to be provided with perforations or openings therein or be mesh-like or strand-like then appropriate material may be chosen for this purpose. In the case where the flexible web 5 is of this type it need not necessarily be of a gas permeable material providing that the plastics material does not cover a substantial proportion of the goods 7. In this way the gas can contact a major proportion of the surface of the goods 7 to enhance the keeping properties of the goods 7. In addition, if the plastics material is of this type and is non-transparent then ideally it should cover as small a portion of the goods 7 as possible so as to leave a maximum surface area viewable to an intending purchaser. Thus, it should be appreciated that the lid 7 is preferably transparent to permit such viewing.

In an embodiment which is the reverse structure of the above, i.e. the packaging is upside down, and the goods 7 are pushed upwardly by the flexible web to engage with the top or lid, the base 1 then becomes the lid 3 and the lid 3 then becomes the base 1. In such case the base under those conditions could then be of a non-transparent material and the flexible web 5 also of a non-transparent material but the then lid would be of a transparent material to permit viewing of the contents by an intending purchaser. It is preferable for at least one of the lid 3 or base 1 to be transparent although it is not essential as a totally non-transparent package could be provided if required.

Figure 2A:
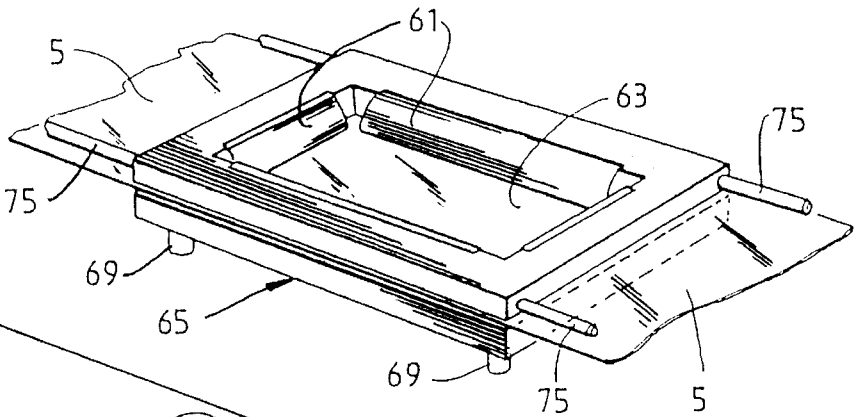
FIG. 2A is a top perspective view of a moving flexible web holding means and lid holding means of the apparatus shown in FIG. 2.
Figure 2:
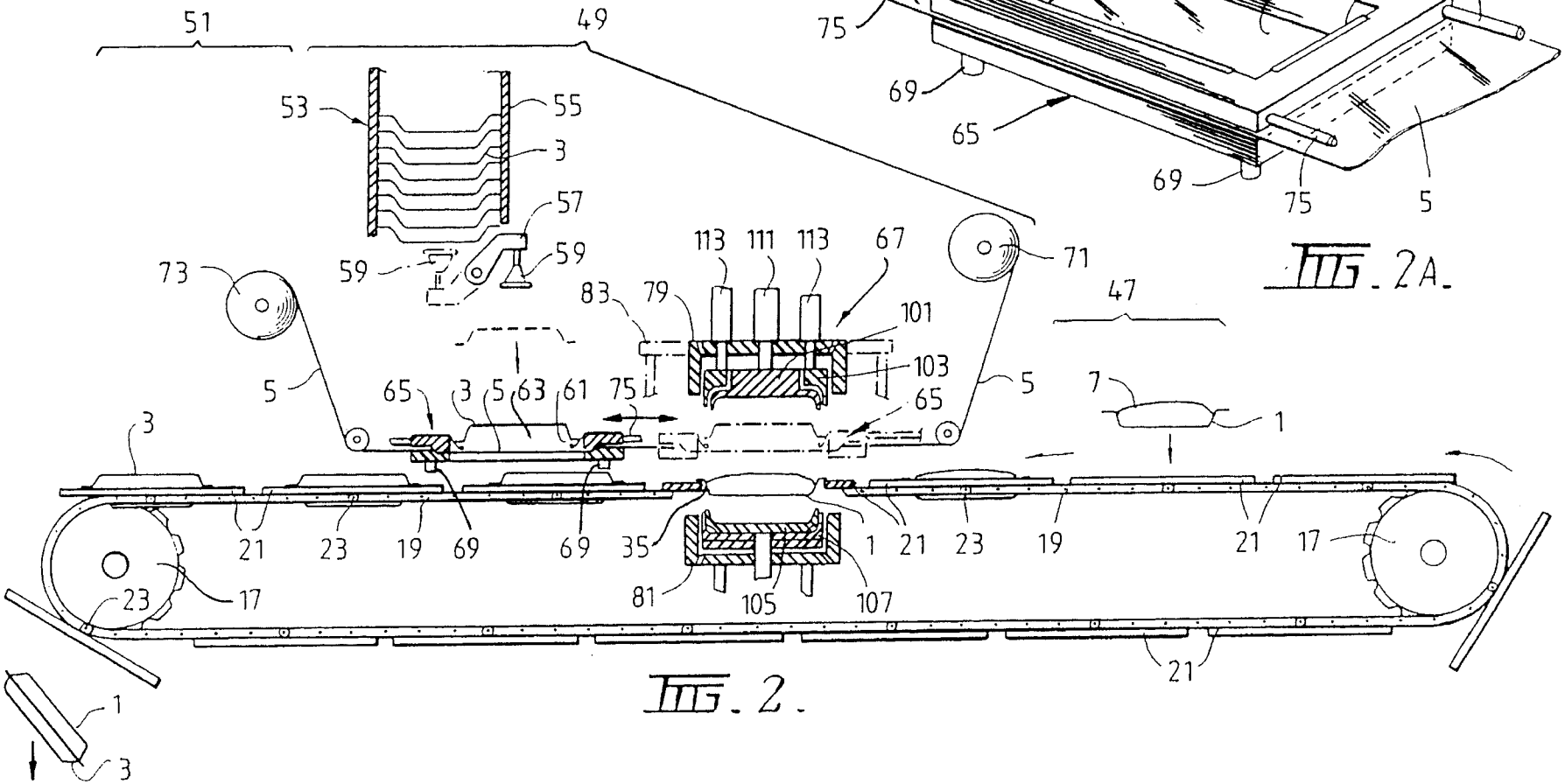
FIG. 2 is a side view in diagrammatic form showing a preferred packaging apparatus for producing the packaging shown in FIG. 1.
Figure 3:
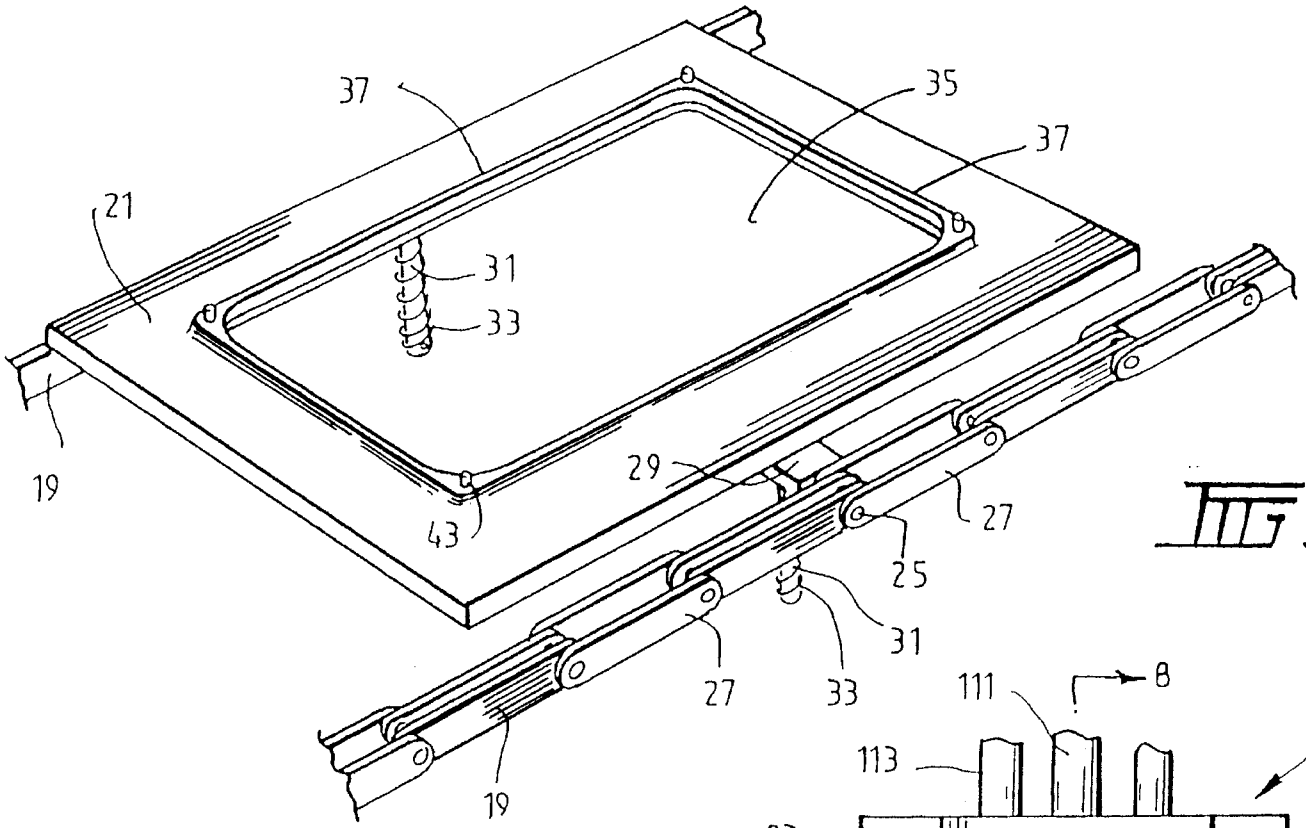
FIG. 3 is a close-up perspective view of one plate means mounted to chains as used in the apparatus showing in FIG. 1.

Referring now to FIG. 2 there is shown a side view in diagrammatic form a typical apparatus used for producing the packaging. Here it can be seen that there are two spaced drive wheels 17 which carry a pair of spaced apart chains 19. A plurality of plate means 21 are attached to the chains 19 so that one of the chain means 19 is at one side of the plate means 21 whilst the other chain means 19 is at the other side of the plate means 21. The connection to the chains 19 is by way of a pivot 23 which is an extension of one the pins 25 connecting the links 27 of the chains 19. FIG. 3 more clearly shows the arrangement. The plate means 21 each have a right angle bracket 29 at each side which connects directly with the pins 25. Rods 31 extend perpendicularly from the under surface of the plate means 21 and pass through the brackets 29. Spring means 33 are held captive over the rods 31 and hold the under surface of the plate means 21 to the upper surface of the brackets 29. The rods are able to move upwardly through the brackets 29 and as a result the springs 33 are compressed. The springs 33 can then return the plate means 21 onto the upper surface of the brackets 29 when the force which moves the plate means 21 upwardly is removed. This will become more apparent in connection with description of further parts of the apparatus.

The plate means 21 each have at least one aperture 35 therein of a size to receive the cup shaped depression of the bases 1. In the apparatus shown only one aperture 35 is shown in each of the plate means 21. It should be appreciated however, that a multitude of apertures 35 may be provided across the plate means 21 between each of the chains 19. By providing more than one aperture 35 then more than one packaging can be produced simultaneously by the apparatus. It is preferred to produce at least three packages simultaneously but in order to aid simplicity of drawings only one aperture 35 has been shown herein in this apparatus.

Figure 4:
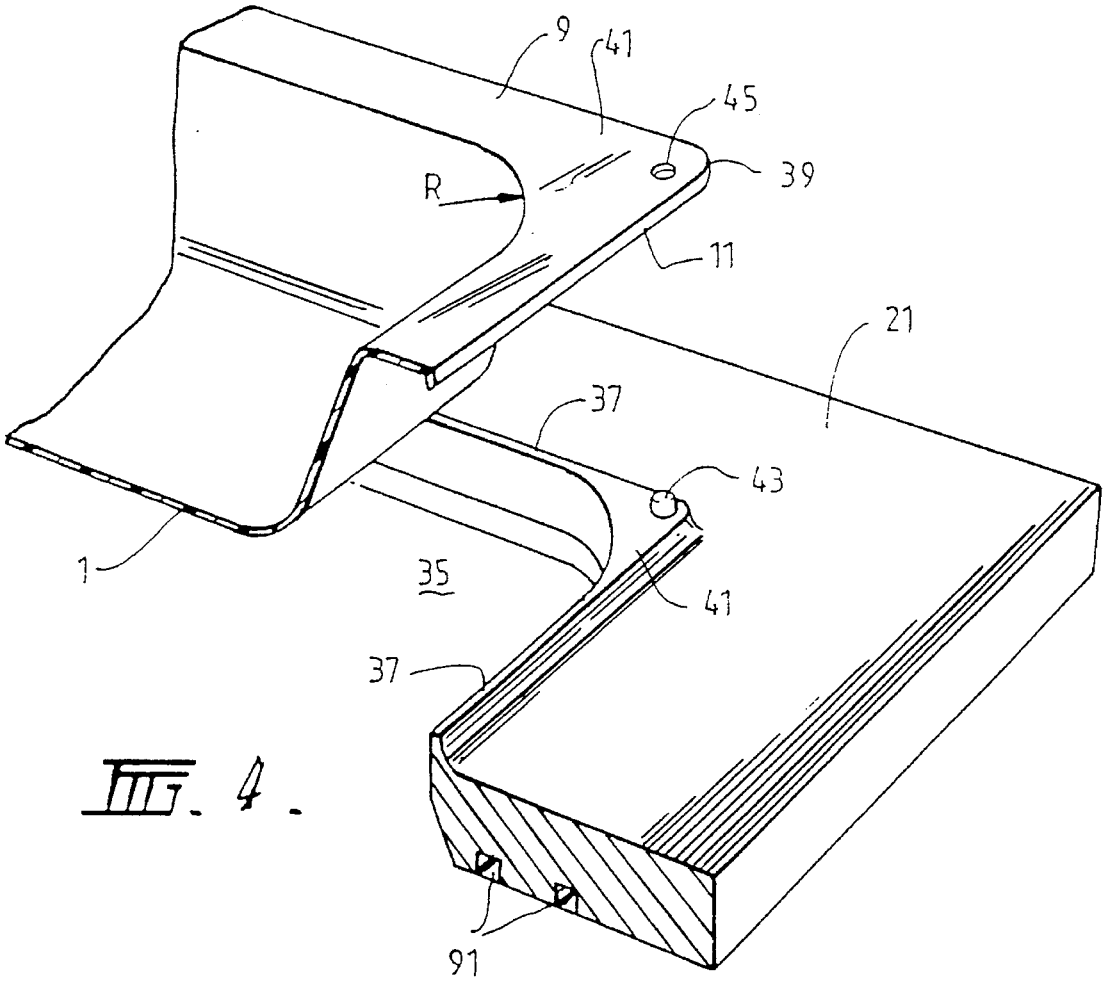
FIG. 4 is an enlarged perspective view of a corner part of the plate means shown in FIG. 3.
Figure 5:
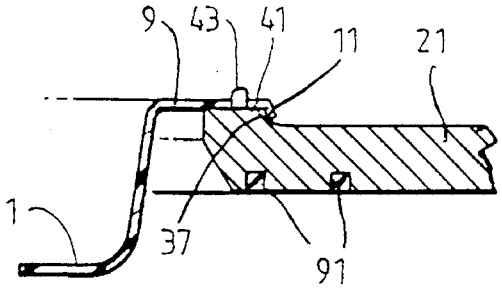
FIG. 5 is a sectional view taken along section line 5—5 in FIG. 6.
Figure 6:
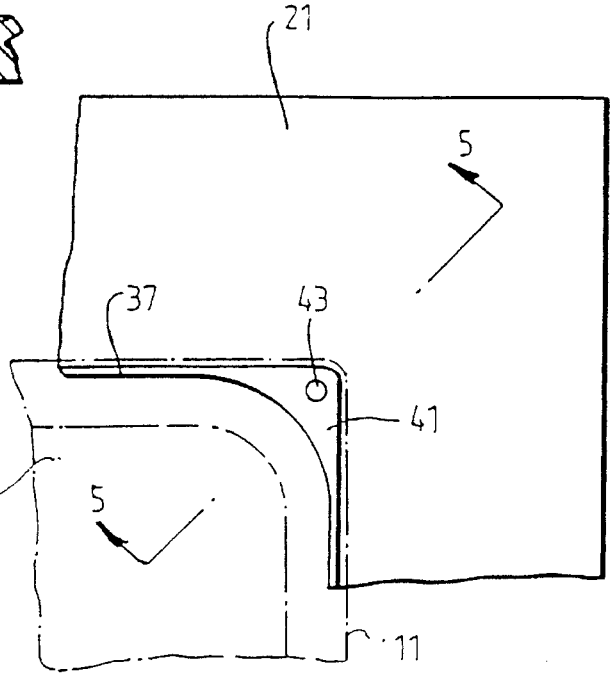
FIG. 6 is a plan view of that part of the plate means shown in FIG. 4.

Accordingly, bases 1 can be received with the cup shaped depression within the aperture 35. The peripheral lip 9 will therefore extend around the perimeter of the opening 35 over the upper surface of the plate means 21. The under surface of the peripheral lip 9 locates on a lip engaging surface 37 which is a continuous surface which extends around the perimeter of the aperture 35. FIGS. 4, 5 and 6 show the arrangement of how the bases 1 fit within the apertures 35 in the plate means 21. FIG. 6 shows that the lip engaging surface 37 is near the outermost edge of the peripheral lip 9 so that the down turned outer edge 11 of the peripheral lip 9 hangs over the lip engaging surface 37. The corners of the bases 1 are curved with a radius R which is considerably greater than the corresponding radius of the extreme outer corner edge 39 of the peripheral lip 9. FIG. 4 and FIG. 6 clearly show that the lip engaging surface 37 closely follows the side contour of the depression in the base 1 whilst there is an overhang portion 41 at each corner 39. Upstanding pins 43 are provided on the upper surface of the plate means 21 and prepunched holes 45 as thermoformed dimples are provided in the overhang portion 41 at each corner edge 39 of the bases 1. FIG. 5 clearly shows that when the bases 1 rest on the plate means 21 the under surface of the peripheral lip 9 rests on the lip engaging surface 37 whilst the over hang portion 41 passes over the pins 43 and that the pins 43 pass through the holes 45. Thus, the bases 1 are supported with the down turned outer edge 11 engaged on the peripherally outermost surface of the lip engaging surface 37 except in the overhang portions 41 but in the overhang portions 41 the lip 11 is also held captive by the pins 43 passing through the holes 45. Thus, when heavy goods such as red meats are loaded into the bases 1 the bases 1 are substantially inhibited from flexing and passing through the aperture 35. This could occur despite the fact that the bases 1 are relatively rigid as the plastics material is not absolutely rigid.

Thus, the chains 19 carry the plate means 21 in closely spaced apart relation in a stepping fashion around the drive wheel 17. The stepping of the movement is controlled by known technology to advance the chains 19 sequentially through various stations in the apparatus. The apparatus comprises three stations, a goods loading station 47, a lid receiving and gas flushing sealing station 49, and a discharge station 51.

At station 47 bases 1 with preloaded goods 7 in the form of red meats are loaded into the apertures 35 in the plate means 21. The plate means then sequentially index through station 49 where a flexible web is applied over the goods 7 and a lid 3 is applied over the flexible web and all the packaging components brought together, gas flushed and sealed closed. The packaged goods exit from the station 49 as individual packages within the plate means 21. They then reach station 51 where they are stripped from the plate means by suitable stripping fingers (not shown). The packages then fall by gravity from the plate means 21 and are collected for subsequent repacking into larger containers for transportation to a sales or storage area. Lids 3 are supplied from a lid dispensing apparatus 53 of known form. The lid dispensing apparatus 53 comprises a chute 55 in which are stored a plurality of lids 3 in nested upside down relationship relative to the intended position of the lids 3 over the bases 1. At the bottom of the shute 55 there is provided an am 57 which can swing between the full line position shown and the dotted line position .shown. Suction cup means 59 are mounted to the arm 57 so that when the arm 57 is in the position shown in the dotted lines the suction cup means 59 is directly under the lowermost lid 3 in the shute 55. Suction can then be applied by reduction of air pressure through the suction cup means 59 which will cause the lowermost lid 3 to be held by the suction cup means 59. The arm 57 then rotates to the position shown in full line and the air pressure is removed from the suction cup means 59 whereupon the lids 3 will have been inverted from the position held within the shute 55 and they will drop by gravity onto flexible lid holding means 61 mounted around the four inside faces of an aperture 63 in a planar pair of flexible web 5 holding means 65. FIG. 2A clearly shows the arrangement of the lid holding means 61. Lid holding means 61 and the function thereof will be more clearly described in relation to FIGS. 8 through 13. The aperture 63 is of a size sufficient to accommodate the outermost peripheral edge of the lip 13 of the lids 3.

Figure 7:
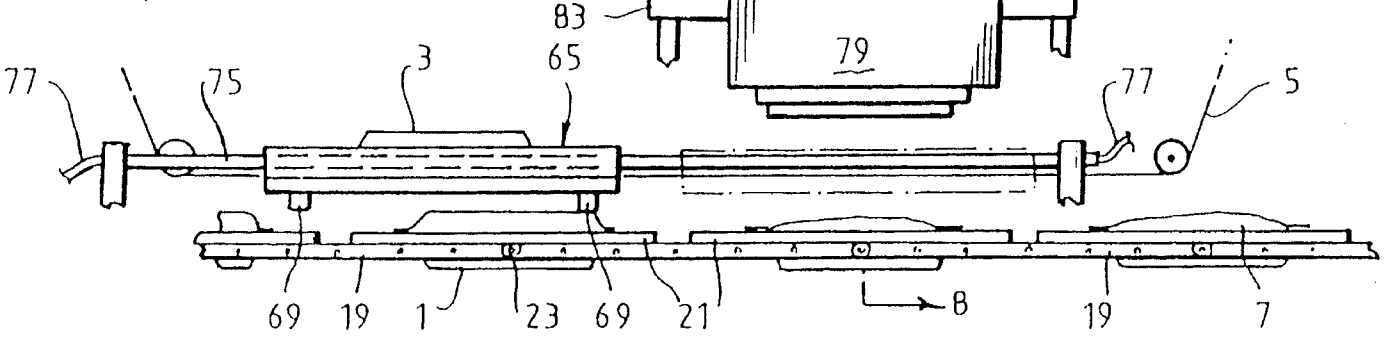
FIG. 7 is a close-up side view of part of the apparatus shown in FIG. 2 showing detail of a moving flexible web holding means and lid holding means.

FIG. 7 shows the arrangement of the planar pair of web holding means 65 which can shuttle backwards and forwards between a lid receiving position and a position where the lids will be placed over bases 1 under chamber means 67. The planar pair of web holding means 65 shuttle backwards and forwards in accordance with the requirement to receive lids and to place the lids over the open bases 1 in the chamber means 67. FIG. 7 also shows that the flexible web 5 is directed between the planar pair of web holding means 65. Pneumatic ram means 69 are carried by the lower one of the planar pair of web holding means 65 and can be activated to raise the lower one of the pair of web holding means 65 to clampingly engage with the flexible web 5. Thus, when the planar pair of web holding means 65 is moved from under the chamber means 67 to a position to receive a lid 3 the ram means are activated to clampingly engage with the web 5 so that as the planar pair of web holding means 65 shuttles to the position to receive the lid 3, it draws web material 5 across the chamber means 67. The web material 5 is unwound from a roll 71 (FIG. 2) and skeletal waste web material is wound onto roll 73. Slipping clutch drive means can be applied to each of the rolls 71 and 73 to provide for the necessary take-up of the skeletal waste material onto roll 73 whilst maintaining a uniform tension across web 5. The movement of web 5 across the chamber means 67 is controlled only by the shuttle movement of the planar pair of web holding means 65.

The planar pair of web holding means 65 is supported on a pair of rodless cylinders 75 (FIG. 2A) to which hydraulic or pneumatic supply is applied through passageways 77 to effect the shuttle movement required.

Referring now to FIG. 2 and in particular to the chamber means 67 it can be seen that the lids 3 are received within the planar pair of web holding means 65. After receiving a lid, the rams 69 are released thereby allowing the lowermost one of the planar pair of web holding means 65 to move away from the upper one of the planar pair of web holding means 65 so that when the planar pair of web holding means 65 are shuttled underneath and into the chamber means 67 they retract over the flexible web 5 and carry the lid 3 into the chamber means 67. FIG. 2 shows the chains 19 broken at the chamber means 67 in order to aid clarity of viewing. Here the plate means 21 can be considered as a base support means and the planar pair of web holding means 65 considered as a moving flexible web holding means and lid holding means. The lids 3 have holes 45 or preformed dimples in alignment with the holes 45 in the bases 1 so that the lids can be aligned relative to the bases 1 by passing over the pins 43 in the plate means 21. The flexible web 5 does not have holes therein as it is sufficiently flexible to deform itself over the pins 43.

Figure 8:
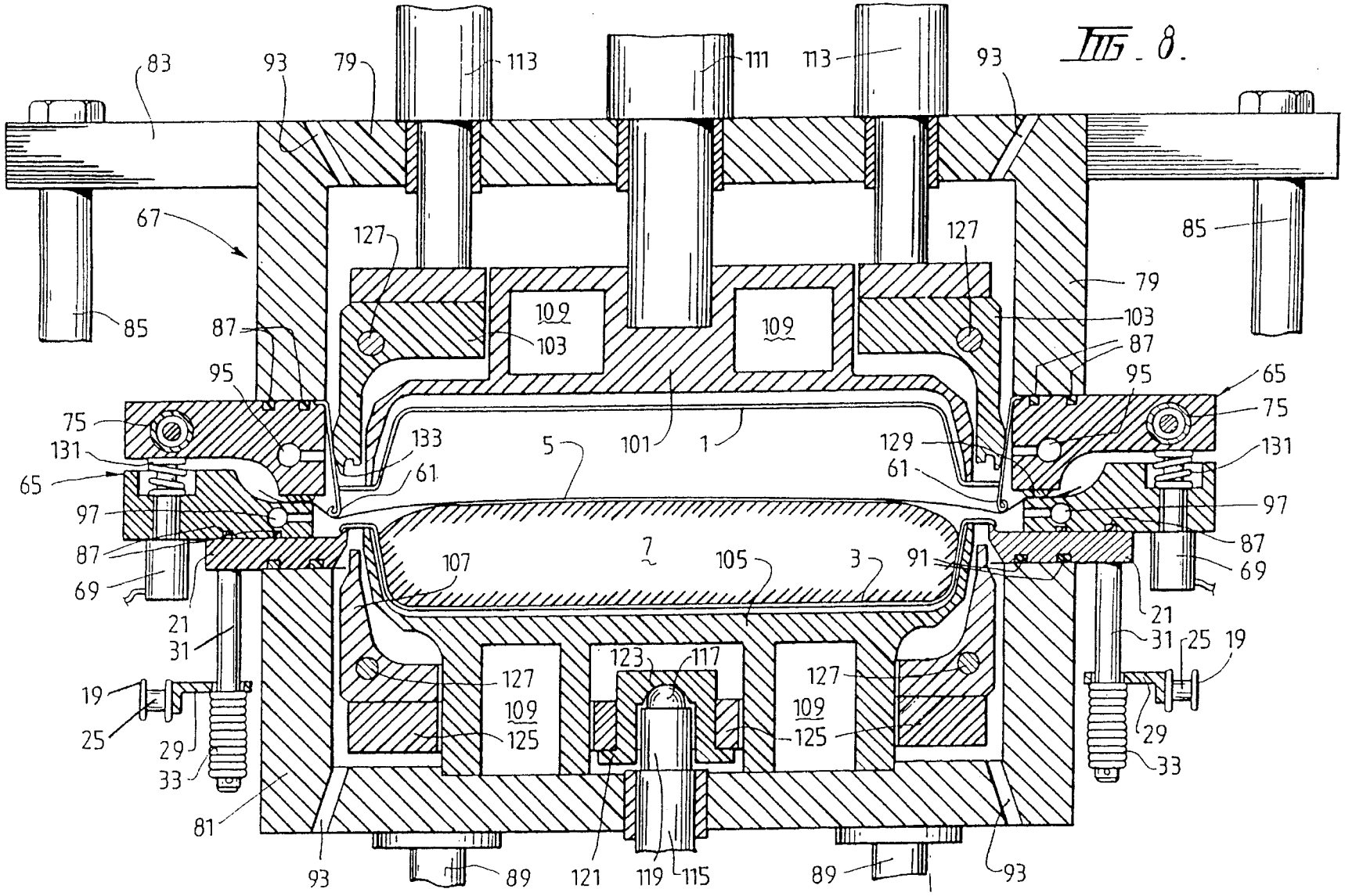
FIG. 8 is a transverse cross sectional view taken along section line 8—8 of FIG. 7.

Referring now to FIG. 8 there is shown a transverse cross sectional view of the chamber means 67. Here it should be appreciated that the upper one of the planar pair of web holding means 65 is retained vertically stationary but all other component parts of the chamber means 67 move relative to the vertically held stationary upper one of the planar pair of web holding means 65. Here it can be seen that the chamber means 67 has an upper outer chamber part 79 and a lower chamber part 81. The upper chamber part 79 is carried on an arm 83 which connects with rams 85. Thus, on operation of rams 85 the upper chamber part 79 can be brought downwardly to sealingly engage on the upper surface of the upper one of the planar pair of web holding means 65. Suitable seals 87 have been shown to effect a gas tight seal. The lower chamber part 81 is connected with rams 89 so it can be raised to engage the under surface of the plate means 21 to, in turn, raise the plate means 21 against the spring bias provided by the springs 33 thus elevating the plate means 21 relative to the chains 19. Seals 91 are provided on the under surface of the plate means 21 to effect a good gas tight seal with the lower chamber part 81. When the lower chamber part 81 is raised to engage the under surface of the plate means 21 so that the plate means 21 is elevated, the plate means 21 engages on the under surface of the lower one of the pair of web holding means 65. The pair of web holding means 65 are held closed by operation of the ram 69 in this condition to hold the web 5 taught across the aperture 63 therein. Thus, when both the upper chamber part 79 and the lower chamber part 81 are closed against the web holding means 65 and against the plate means 21 there is closing and sealing of the chamber means 67. The upper chamber part 79 and the lower chamber part 81 have air evacuation openings 93 therein. Equal air pressure is reduced from the upper chamber part 79 and the lower chamber part 81 in order not to cause the flexible web 5 to distort unduly. Thus, by controlling equal air pressures across flexible web 5 there can be a reduction of air pressure within the chamber 67 and then a required gas introduced into the chamber 67 through gas passageways 95 in the upper one of the pair of web holding means 65, and 97 in the lower one of the pair of the web holding means 65. Thus, a required gas for enhancing the keeping properties of the packaged goods 7 can be introduced into the chamber 7 prior to bringing together of the packaging components. Thus, when the packaging components are sealed together there will be a desired gas within the packaging. Typically for red meats the gas is 80% $O_2$ and 20% $CO_2$ in combination. The pressure of the gas is chosen to be approximately equal to atmospheric pressure so that the package will not bow outwardly or inwardly when removed from the chamber 67.

It should be appreciated that during the evacuation process the gas pressure under the flexible web 5 may be slightly lower than that above the flexible web 5 to allow for at least partial pre-stretching of the flexible web 5 towards the goods 7. It should also be appreciated that the gas below web 5 may be different to the gas above web 5 if required. This arrangement of providing different gases within the package above and below web 5 may be provided so that for an initial period of time there will be a certain gas provided to directly contact the goods 7 whilst after an initial period the gas within the space above web 5 can permeate web 5 and contact the goods 7. Thus, for example, the gas under web 5 may have properties which will initially inhibit growth of bacteria whilst the gas above web 5 may be provided with a predominantly oxygenating gas which for red meats will enhance the colour keeping properties over a period of time.

Mounted within the chamber 67 is an upper pushing platen 101 and an upper heated sealing member 103. There is also mounted a lower pushing platen 105 and a heated sealing member 107. Both the upper and lower pushing platens 101 and 105 are water cooled and have water passageways 109 therethrough. The upper pushing platen 101 is connected with a ram 111 to effect raising and lowering relative to the upper chamber parts 79. The heated sealing member 103 is connected with rams 113 to effect raising and lowering relative to the upper chamber part 79. The lower pushing platen 105 is connected directly to the lower chamber part 81 and is raised and lowered with the lower chamber part 81 by operation of the rams 89. The lower pushing member 105 is operated through a ram 115 to be raised upwardly relative to lower chamber part 81. FIG. 8 shows that the ram 115 has a hemispherical head 117 and that the head 117 is on an extension 119 of the ram 115. The extension 119 fits within a cup shape member 121 which has an internal bore slightly larger than that of the diameter of the extension 119. The bottom of the bore in the cup shape member 121 has a concave hemispherical surface 123 against which the hemispherical surface 117 of the head can engage. The cup shape member 121 directly engages with a plate 125 which, in turn, contacts directly with the heated sealing member 107. Because the heated sealing member 107 is mounted relative to the ram 115 in this way, it can swing within limited confines to align itself directly underneath the corresponding heated sealing member 103 in the upper chamber part 79 so there will be good close mating relationship around the peripheral lips 9 and 13 of the base and lid respectively to effect good hermatic sealing by a heat sealing technique. The tolerance between the external diameter of the extension 119 of ram 115 and the internal bore in the cup shape member 121 is such that there cannot be angular movement of the heated sealing member 107 to contact the sides of the lower chamber part 81 or the plate means 21.

Each of the heated sealing members 103 and 107 is heated by electrical heating elements provided within passageways 127.

Referring now to FIGS. 9 through 13 a series of steps can be followed which show how the packaging components are brought together and sealed within the chamber 67.

FIG. 9 shows the arrangement where a lid 3 is received within the planar pair of web holding means 65 and supported by the lid holding means 61. It also shows that the flexible web 5 is held clamped between the pair of web holding means 65. Thus, the web 5 is held taught with the tension applied between the roll 71 and 73 by the clamping action of the pair of web holding means 65. It is noted that the under surface of the upper one of the pair of web holding means 65 has a peripherally extending rib 129 which is of circular cross section. Thus there will be substantially point contact holding of the web 5 between the upper one and the lower one of the pair of web holding means 65. If required the rib 129 can be of a rubber or other suitable resilient material to deform slightly and to effect good holding of the web 5 across the aperture 63 in the pair of web holding means 65. FIG. 9 shows that spring means 131 are provided between the upper and lower ones of the pair of web holding means 65 to assist moving apart of the upper and lower ones when the rams 69 are operated to release clamping action therebetween.

Figure 10:
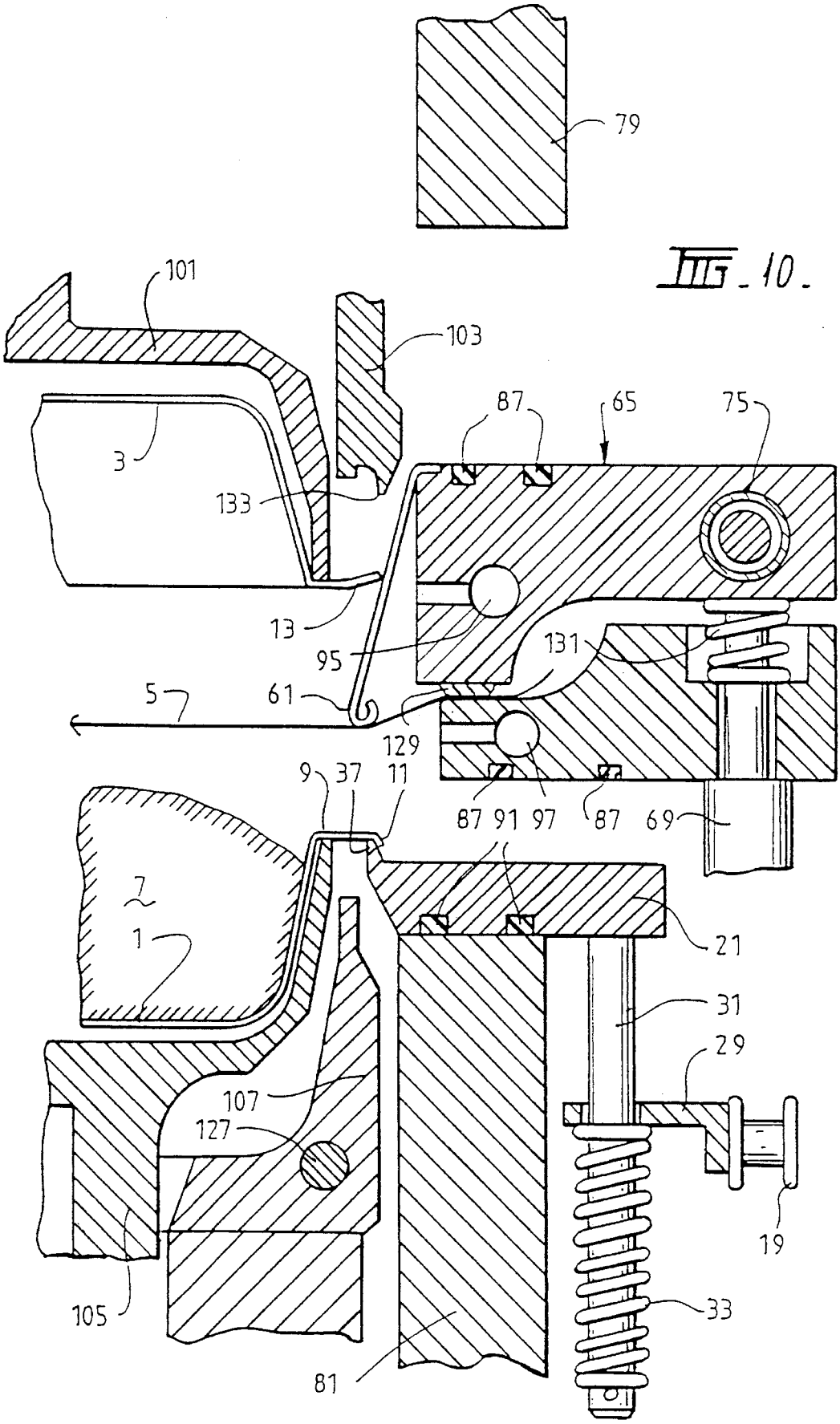

Referring now to FIG. 10 there is shown the next stage in the method steps. Here it can be shown that the lower chamber part 81 has been raised to engage with the under surface of the plate means 21 and that the plate means 21 has been elevated relative to the chains 19. It also shows that the lower pushing platen 105 engages with the under surface of the lip 9 without lifting the lip 9 off the lip engaging surface 37 on the plate means 21. It also shows that the upper pushing platen 101 has started to move the lid 3 downwards. In the process of moving the lid 3 downwards the peripheral lip 13 engages with the lid holding means 61 which previously supported the lid 3 near to the top of the pair of web holding means 65. As the upper pushing platen 101 is moved downwardly the lip 13 deflects slightly as shown. In addition, the lid holding means 61 flexes and swings towards the side edges of the pair of web holding means 65 and causes stretching of the flexible web 5 towards the goods 7. It is noted that the lowermost end of the lid holding means 61 is curved so as not to rupture the flexible web 5. Typically, the lid holding means 61 comprises a sheet of stainless steel which is quite flexible. Thus, there are four lid holding means 61 around each inside face of the aperture 63 in the pair of web holding means 65.

Figure 11:
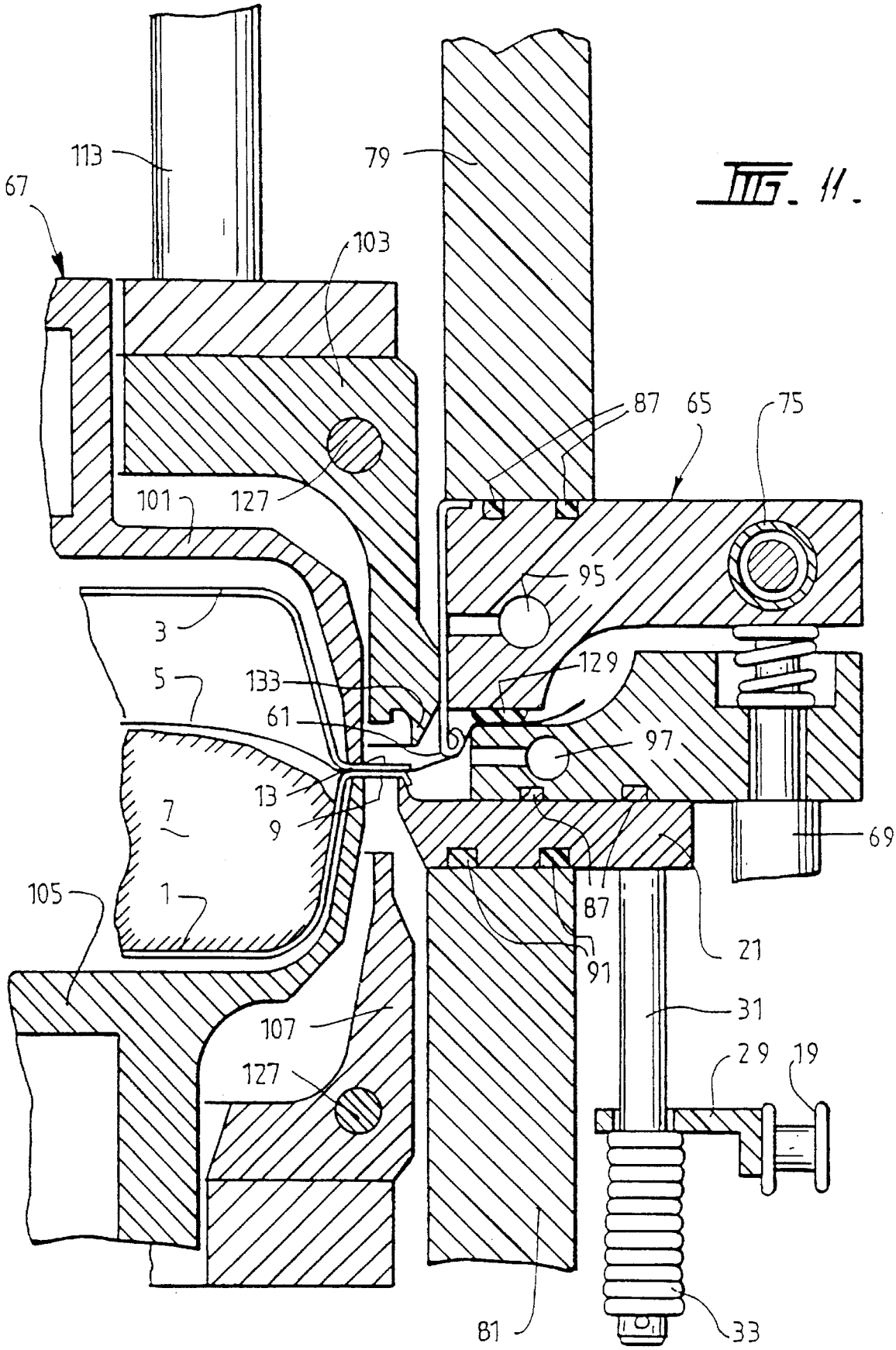

FIG. 11 shows the arrangement where the lower chamber 81 has raised the plate means 21 to engage the under surface of the lower one of the pair of web holding means 65. It also shows that the upper chamber part 79 has been moved downwardly and closed against the upper surface of the upper one of the pair of web holding means 65. Thus the chamber 67 is now sealed closed. FIG. 10 also shows that the lower pushing platen 105 cooperates with the upper pushing platen 101 to seal the lid 3 relative to the base 1. Thus, prior to the bringing together of the lower pushing platen 105 and the upper pushing platen 101 there has been sealing of chamber 67, evacuation of atmosphere therefrom, and introduction of desired gases through the gas passageways 95 and 97. Thus, when the lower pushing platen 105 cooperates with the upper pushing platen 101 to seal the lid 3 relative to base 1 with the flexible web therebetween, the desired gas will be within the packaging components. FIG. 11 also shows that the upper sealing member 103 has moved downwardly relative to that in FIG. 10 so as to push the lid holding means 61 against the inside face of the upper one of the pair of web holding means 65. This process also stretches the flexible web 5 across the goods 7. As the lower pushing platen 105 engages and cooperates with the upper pushing platen 101 there will be further stretching of the flexible web 5 over the top surface of the goods 7. Thus, at the step shown in FIG. 11 the flexible web 5 will have been stretched initially by the lid holding means 61 and then subsequently stretched again over the upper surface of the goods 7 by the bringing together of the lower pushing platen 105 and the upper pushing platen 101.

Figure 12:
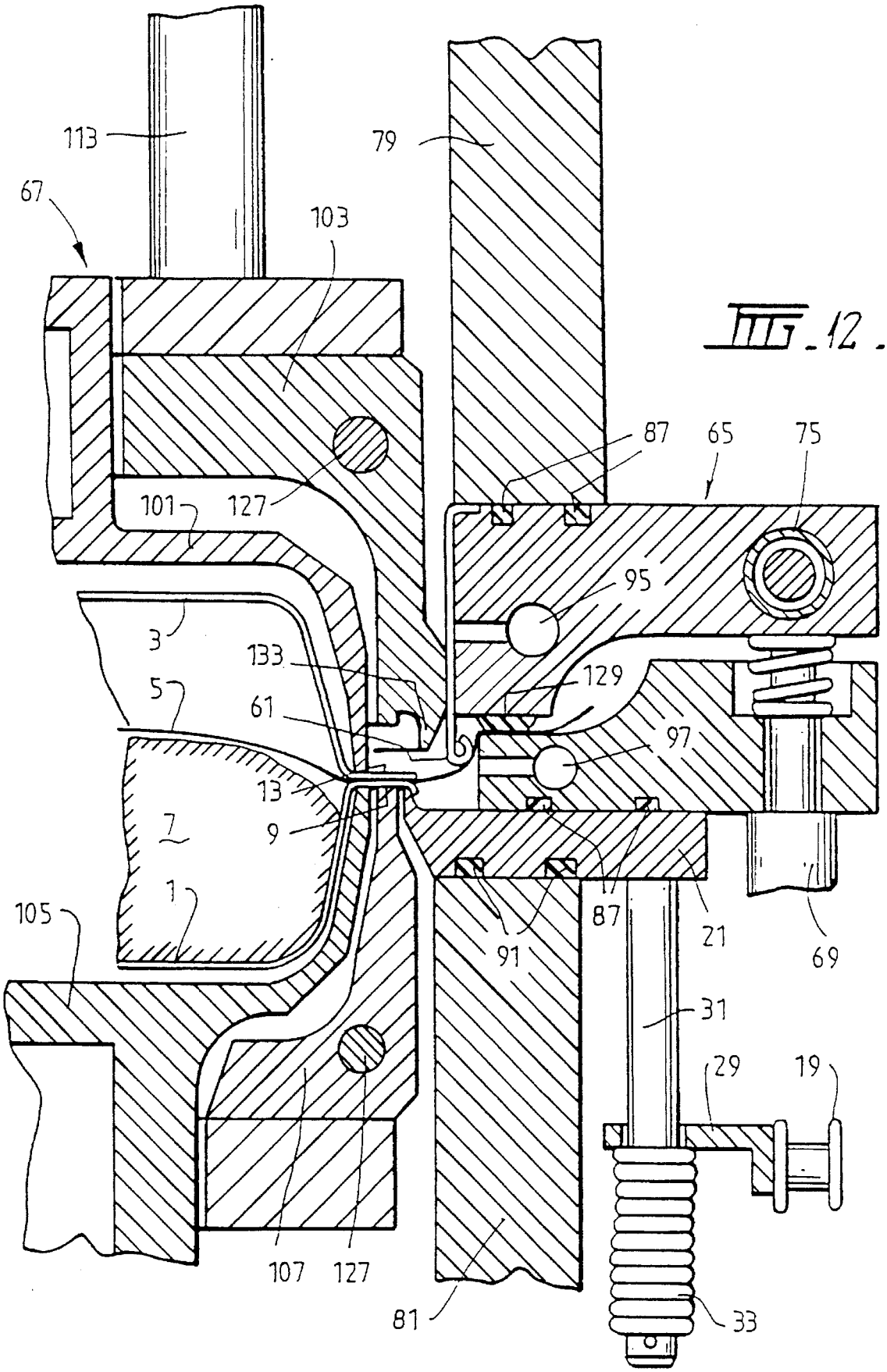

FIG. 12 shows the arrangement at the next step of production of the packaging where the lower heated sealing member 107 has been raised to engage the under surface of the peripheral lip 9 of the base 1. The base 1 is still supported by the lip engaging surface 37 on the plate means 21.

Figure 13:
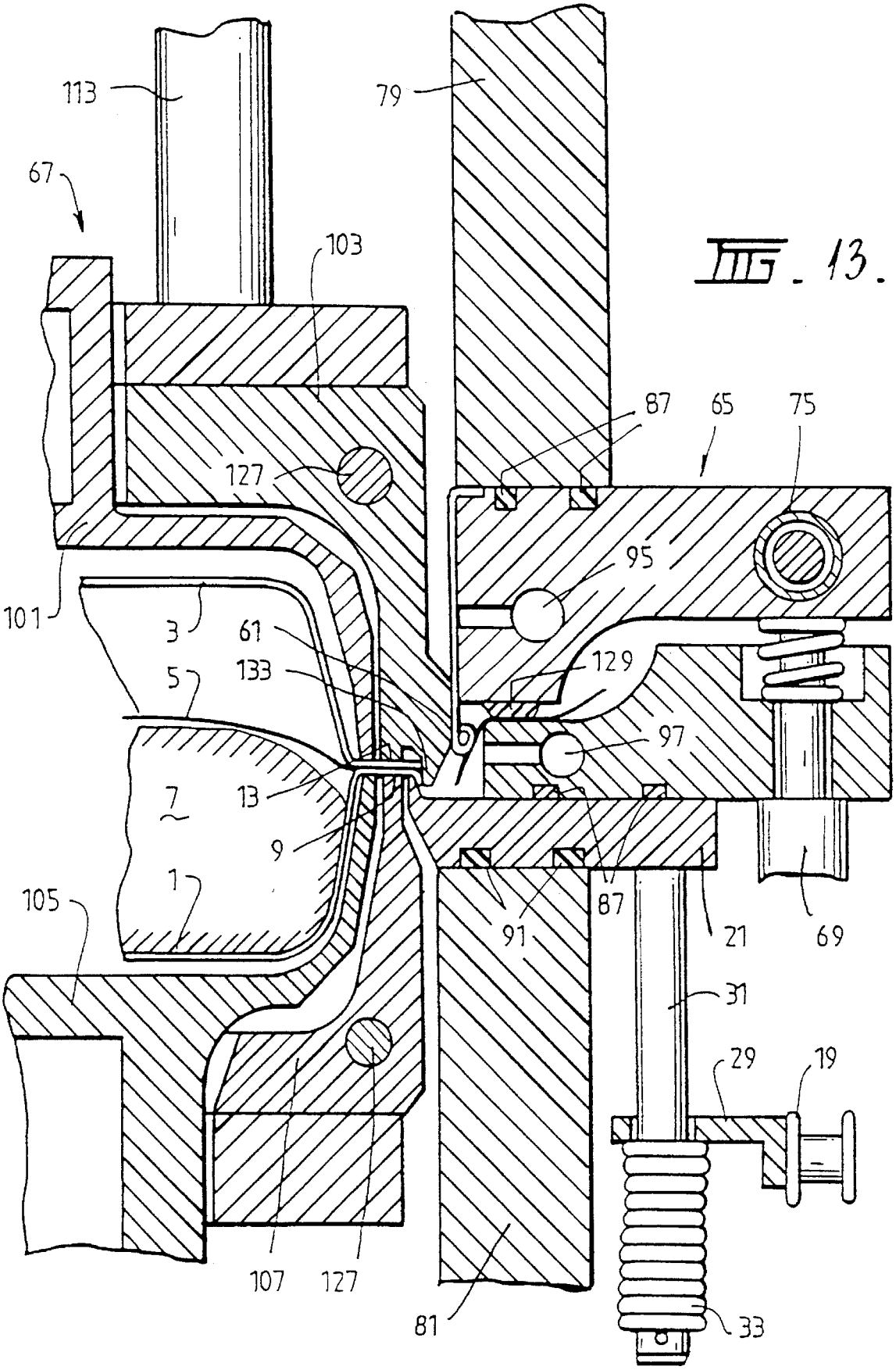

FIG. 13 shows the next stage in the production of the packaging where the upper sealing member 103 has been lowered to engage the upper surface of the peripheral lip 13 of the lid 3 to effect a peripheral seal around the perimeter of the packaging. It also shows that the forward end of the upper heated sealing member 103 has a knife edge 133 which extends downwardly sufficient to sever web 5 at the outer peripheral edge of the packaging when it contacts web 5. Thus, at this stage, the packaging has been sealed closed with the desired gas therein and the flexible web 5 has been severed from the main web extending between rolls 71 and 73. Thus the remaining skeletal portion of flexible web 5 can be moved and wound onto roll 73 when the chamber 67 is opened and all of the pushing platens and heat sealing members returned to their initial position shown in FIG. 9.

The sequencing of operation of the various components of the apparatus have not been shown or explained in circuit diagrams as it is considered that the design and operation functions can be readily duplicated by persons skilled in production of packaging machinery. It is considered that the disclosure herein is sufficient to enable a person skilled in the production of packaging machinery to produce the necessary equipment for that purpose, It is also considered that the disclosure herein is sufficient in its description of the plastic material types to enable a person skilled in the art of packaging to produce a packaging of the required characteristics where the outer packaging components are sufficiently rigid to provide protection and support for the goods 7 and where the inner flexible web 5 holds the goods 7 relative to the base 1 and allows the desired gas to permeate to enhance the keeping qualities of the goods 7 or to provide other means such as the web 5 with apertures therein and/or be strand-like to enable the gas to contact the goods 7 to enhance their keeping properties, It should also be appreciated that the plastics material for the base 1 and lid 3 are substantially gas impervious and thus the goods 7 will be packed within a substantially controlled gas environment, Modifications may be made to the present invention as would be apparent to persons skilled in the packaging arts, These and other modifications may be made without departing from the ambient of the invention the nature of which is to be determined from the foregoing disclosure.

I claim:

1. An improved method for packaging perishable goods comprising the following steps:

(a) providing a base with perishable goods over said base;

(b) aligning a flexible web of material over said base and said perishable goods;

(c) aligning a lid over said flexible web, and in alignment with said base and said perishable goods;

(d) applying a member to said flexible web to stretchingly deform said flexible web towards said perishable goods over said base;

(e) closing a gas flushing chamber means over said base and said lid;

(f) gas flushing said gas flushing chamber with a suitable gas for enhancing the keeping properties of the perishable goods;

(g) relatively moving said lid, the stretchingly deformed flexible web, and the base together within said gas flushing chamber;

(h) causing the stretchingly deformed flexible web to engage with said perishable goods and said base; and (i) sealing said lid, said flexible web and said base together whereby said perishable goods will be held to said base and there will be said suitable gas within said packaging.

2. A method as claimed in claim 1 wherein the suitable gas is sealed in at least a space between the lid and said flexible web, and said flexible web is gas permeable to permit said suitable gas to permeate said flexible web for enhanced keeping properties of said packaged goods.

3. A method as claimed in claim 1 wherein said flexible web is of open mesh like structure so said suitable gas can contact said goods by passing through said mesh.

4. A method as claimed in claim 1 wherein said flexible web comprises strand like material.

5. A method as claimed in claim 1 comprising holding said flexible web between a pair of web holding means so that when step (d) is performed said flexible web will be held thereby.

6. A method as claimed in claim 5 wherein said flexible web is a continuous web which passes between said pair of web holding means, said pair of web holding means being generally planar with an aperture therethrough and through which said lid can be passed and comprising the further steps of bringing said pair of web holding means together and hold said flexible web, displacing said pair of web holding means from said gas flushing chamber whilst holding said flexible web whereby to draw said flexible web into said gas flushing chamber, receiving a lid onto said pair of web holding means, moving said pair of web holding means apart to release said flexible web, displacing said pair of web holding means to be returned to said gas flushing chamber without returning said flexible web therewith, and carrying said lid therewith to place said lid within said gas flushing chamber over said flexible web which has been drawn into said gas flushing chamber.

7. A method as claimed in claim 6 wherein said pair of web holding means is held relatively vertically stationary within said gas flushing chamber and said base and said lid are moved relative thereto to bring them to said flexible web.

8. A method as claimed in claim 6 wherein said lid is held by said member which stretchingly deforms said flexible web and which forms part of said pair of web holding means whereby to provide lid holding means and wherein step (d) is performed by moving said lid towards said flexible web and moving said member to stretchingly deform said flexible web.

9. Apparatus for providing packaging comprising:

a gas flushing chamber means of sufficient volume to accommodate:

(i) a base with perishable goods over said base;

(ii) a flexible web of material over said base and said perishable goods;

(iii) a lid over said flexible web of material and in alignment with said base and said perishable goods;

said base being supportable on a base support means, said flexible web being, in use, between a pair of web holding means;

there being stretching means between said lid and said flexible web; and sealing means for effecting sealing of said lid, said flexible web and said base together, all within said gas flushing chamber means, the arrangement being such that said stretching means can be moved to stretchingly deform said flexible web towards said perishable goods following holding of said flexible web by said web holding means and there can be relative movement of said base support means, said web holding means, said lid and said member towards each other, whereby said base, said stretchingly deformed flexible web and said lid can be brought together and sealed together with a desired gas between at least said flexible web and said lid within said gas flushing chamber, and so said perishable goods will be held to said base by said flexible web being stretched and engaged with said goods to hold said goods to said base.

10. Apparatus as claimed in claim 9 wherein said stretching means comprises lid holding means which can move to stretch said flexible web by the movement of said lid towards said flexible web.

11. Apparatus as claimed in claim 10 wherein said lid holding means is mounted to said pair of web holding means.

12. Apparatus as claimed in claim 11 wherein said pair of web holding means can be displaced from said gas flushing chamber to receive a lid and then be returned to said gas flushing chamber with said lid.

13. Apparatus as claimed in claim 12 wherein said pair of web holding means are moveable together to clampingly hold said flexible web therebetween, so that when said pair of web holding means is displaced to receive a lid it can draw part of a continuous web of said flexible web into said chamber, whereupon following such movement said pair of web holding means can be moved to release holding said flexible web so that when returned to said gas flushing chamber it will not displace the part of the flexible web drawn thereinto.

14. Apparatus as claimed in claim 13 wherein said pair of web holding means can be moved together to hold said flexible web as said stretching means is moved to stretch said flexible web.

15. Apparatus as claimed in claim 12 wherein said pair of web holding means are held vertically stationary and said gas flushing chamber is closed about said pair of web holding means.

16. Apparatus as claimed in claim 15 comprising a platen to push said lid towards said flexible web to, in turn, cause said lid holding means to move to stretch said flexible web.

17. Apparatus as claimed in claim 16 comprising a further platen which will cooperate with said platen to hold said lid, said flexible web and said base closed; and sealing means for then sealing said packaging with said desired gas therein.

18. Apparatus as claimed in claim 17 wherein said desired gas is expelled in said gas flushing chamber from gas passageways in said pair of web holding means.

19. Apparatus as claimed in claim 18 wherein said gas passageway means expel said desired gas both above and below said flexible web.

20. Apparatus as claimed in claim 19 wherein said base support is mounted to drive means with other similar base support means and said drive means can move said base support means to serially index to said gas flushing chamber so bases with goods over said bases can be indexed into said gas flushing chamber.

21. An improved method for packaging goods having the following steps:

(a) providing a gas barrier base with goods over said base;

(b) aligning a gas permeable web over said base and said goods, said gas permeable web being less rigid than said base so that said permeable web covers said goods and is not sealed to said base;

(c) aligning a gas barrier lid over said gas permeable web, and in alignment with said base and said goods;

(d) stretching said gas permeable web;

(e) sealing closed a gas flushing chamber means about said base and said lid;

(f) then gas flushing said gas flushing chamber means with a suitable gas for enhancing the keeping of the goods;

(g) then sealing said lid, said stretched gas permeable web and said base together at a seal path which extends near what will be a perimeter of the resulting packaging and which extends completely around said perimeter, said sealing being effected while said stretched gas permeable web is still stretched and said gas flushing chamber means is still closed, whereby said goods and said gas will be sealed within said packaging; and (h) allowing said suitable gas to permeate said gas permeable web.

22. An improved method as claimed in claim 21, comprising at step (f) evacuating said gas flushing chamber means prior to gas flushing.

23. Apparatus for providing packaging comprising:

a gas flushing chamber means of sufficient volume to accommodate:

(i) a gas barrier base with goods over said base;

(ii) a gas permeable web which is less rigid than said base extending over said base and said goods, said gas permeable web not being sealed to said base;

(iii) a gas barrier lid over said gas permeable web and in alignment with said base and said goods;

(iv) sealing means for effecting sealing of said lid, said gas permeable web and said base together at a seal path which extends near what will be a perimeter of the resulting packaging and which extends completely around said perimeter, the arrangement being such that said base, said gas permeable web and said lid can be brought together, said gas permeable web can be stretched, the gas flushing chamber can be closed, evacuated and then gas flushed with a gas for enhancing keeping of the goods, and the sealing effected while said gas permeable web is still stretched and said gas flushing chamber is closed.

* * * * *